US008733586B2

(12) United States Patent
Uno et al.

(10) Patent No.: US 8,733,586 B2
(45) Date of Patent: May 27, 2014

(54) DRUG SORTING DEVICE

(75) Inventors: Tsuyoshi Uno, Gifu (JP); Hada Hong, Gifu (JP)

(73) Assignee: Nakasu Electric Co., Ltd., Gifu (JP)

( * ) Notice: Subject to any disclaimer, the term of this patent is extended or adjusted under 35 U.S.C. 154(b) by 0 days.

(21) Appl. No.: 13/704,992

(22) PCT Filed: Feb. 27, 2012

(86) PCT No.: PCT/JP2012/001313

§ 371 (c)(1),
(2), (4) Date: Jan. 15, 2013

(87) PCT Pub. No.: WO2012/120819

PCT Pub. Date: Sep. 13, 2012

(65) Prior Publication Data

US 2013/0105277 A1 May 2, 2013

(30) Foreign Application Priority Data

Mar. 4, 2011 (JP) ..... 2011-047870

(51) Int. Cl.

| | |
|---|---|
| ***B65B 1/30*** | (2006.01) |
| ***B65B 35/06*** | (2006.01) |
| ***A61J 3/00*** | (2006.01) |

(52) U.S. Cl.

USPC ..... 221/242; 221/241; 221/304; 53/248; 53/250

(58) Field of Classification Search

USPC ..... 198/418.2, 418.3, 418.6, 427; 221/71, 221/74, 124, 131, 197, 241, 242, 277, 304; 53/202, 248, 250, 473, 900

See application file for complete search history.

(56) References Cited

U.S. PATENT DOCUMENTS

| | | | | |
|---|---|---|---|---|
| 3,139,713 | A * | 7/1964 | Merrill et al. | 53/55 |
| 3,417,542 | A * | 12/1968 | Merrill et al. | 53/167 |
| 4,046,285 | A * | 9/1977 | Wendt | 221/157 |

(Continued)

FOREIGN PATENT DOCUMENTS

| | | |
|---|---|---|
| JP | 2010524582 | 7/2010 |
| JP | 2010538921 | 12/2010 |

OTHER PUBLICATIONS

International Search Report in international application No. PCT/JP2012/001313, mailed on Mar. 19, 2012.

*Primary Examiner* — Douglas Hess
(74) *Attorney, Agent, or Firm* — Oppedahl Patent Law Firm LLC

(57) ABSTRACT

[Problem] To provide a drug-sorting device for dispensing multiple drugs.

[Solution] This drug-sorting device is equipped with multiple receiving parts that have an opening and are arranged side-by-side in the longitudinal direction, a conveyor means for conveying drugs into the respective receiving parts, and a first adjustment means for changing the width of the openings. Said first adjustment means is provided with a rail that extends in the longitudinal direction, multiple partitioning parts that partition two adjacent receiving parts and are slidable along the rail, and a rotatable width adjustment drum. On the width adjustment drum, multiple guide grooves are arranged side-by-side at equal intervals in the longitudinal direction and extend so as not to be parallel to each other in the circumferential direction. When the width adjustment drum is rotated, the multiple partitioning parts are guided by the respective guide grooves and slide along the rail in the longitudinal direction, thereby changing the width of the respective openings. When the drugs are conveyed, the respective openings are occluded by the respective drugs that have been conveyed into the respective receiving parts.

8 Claims, 11 Drawing Sheets

(56) References Cited

U.S. PATENT DOCUMENTS

| | | | | |
|---|---|---|---|---|
| 4,674,259 | A * | 6/1987 | Hills | 53/202 |
| 5,463,839 | A * | 11/1995 | Stange et al. | 53/54 |
| 6,505,460 | B2 * | 1/2003 | Aylward | 53/473 |
| 6,799,413 | B2 * | 10/2004 | Aylward | 53/473 |
| 8,006,468 | B2 * | 8/2011 | Bassani | 53/475 |
| 8,099,929 | B2 * | 1/2012 | Kirby et al. | 53/244 |
| 8,146,331 | B2 * | 4/2012 | Soloman | 53/493 |
| 8,157,125 | B2 * | 4/2012 | Schiff | 221/74 |
| 8,424,274 | B2 * | 4/2013 | Aylward et al. | 53/473 |
| 2008/0257904 | A1 | 10/2008 | Schiff | |
| 2011/0011882 | A1 | 1/2011 | Kirby | |

* cited by examiner

DRUG SORTING DEVICE

TECHNICAL FIELD

The present invention relates to a pharmaceutical sorting device for dispensing pharmaceuticals to groups of a predetermined amount of pharmaceuticals.

BACKGROUND ART

Automated pharmaceutical packaging devices that automatically dispense pharmaceuticals based on prescriptions and automatically package pharmaceuticals per prescription or per patient are known. However, such automated pharmaceutical packaging devices generally have a complex structure and are expensive, so that it is not practical for small-scale pharmacies or individuals to install an automated pharmaceutical packaging device. Thus, manual pharmaceutical sorting devices that are more reasonably priced than expensive automated pharmaceutical packaging devices and easy to use are still needed.

A pharmaceutical sorting device of Patent Document 1, for example, includes a support frame (7), a tablet bucket (8) having a plurality of cells (8*c*) and an open/close shutter (8*f*) that doubles as the bottom plate of the cells (8*c*), and a tablet tray (9, 9') supported on the support frame (7) above the tablet bucket (8). The tablet bucket (8) is configured to be slidable relative to the support frame (7). When the tablet bucket (8) moves forward by one cell, the open/close shutter (8f) is released from the support table and drops down by gravity to open, while, when the tablet bucket (8) moves backward, the open/close shutter (8f) is closed. That is, pharmaceuticals (6) in the cells (8c) are dropped down as the tablet bucket is slid forward, so that the pharmaceuticals are dispensed to groups of a number of the cells. When the pharmaceuticals in the tablet bucket (8) have run out, a shutter actuation mechanism (10) operated by a solenoid (10a) opens open/close shutters (9d) inside cells (9c) of the tablet tray (9) so that pharmaceuticals (6) are supplied to the respective cells (8c) of the tablet bucket (8).

PRIOR ART DOCUMENTS

Patent Documents

Patent Document 1: Japanese Patent Application Laid-open No. 60-148402

SUMMARY OF THE INVENTION

However, with the pharmaceutical sorting device of Patent Document 1, it is necessary to first place pharmaceuticals in each cell of the tablet tray (or tablet bucket) as required, which is a very time-consuming task. Another problem is that, as the open/close shutter is opened and closed with an electrical shutter actuation mechanism so that pharmaceuticals can be automatically supplied from the tablet tray to the tablet bucket, the overall structure of the device is complex, and the initial cost of installing the device is high.

Accordingly, an object of the present invention is to provide a pharmaceutical sorting device capable of dispensing pharmaceuticals easily and quickly with a simple structure.

Means for Solving the Problems

The pharmaceutical sorting device according to claim 1 is a pharmaceutical sorting device for dispensing a plurality of pharmaceuticals, including: a plurality of receptacles for receiving respective pharmaceuticals, arranged side by side along a longitudinal direction and each having an opening for the pharmaceutical to pass through; conveyor unit for conveying the pharmaceuticals into the respective receptacles through the openings; and first adjusting unit changing a width of the openings in accordance with a size of the pharmaceuticals. The first adjusting unit includes a rail extending in the longitudinal direction, a plurality of partitions partitioning two adjacent receptacles and slidable along the rail, and a cylindrical width adjusting drum arranged along the rail and rotatable around an axis extending in the longitudinal direction. The width adjusting drum has a plurality of guide grooves formed side by side at equal intervals in the longitudinal direction such as to extend non-parallel to one another along an outer circumferential direction, so as to guide a sliding movement of the plurality of partitions. The width of the respective openings is changed by a sliding movement in the longitudinal direction along the rail of the plurality of partitions as guided by the respective guide grooves when the width adjusting drum rotates. The respective openings become plugged by the pharmaceuticals when the pharmaceuticals are conveyed into the respective receptacles.

In the pharmaceutical sorting device according to claim 1, as defined in claim 2, the respective guide grooves on the width adjusting drum extend, when viewed in a development view, radially from a converging point P where extension lines of the respective guide grooves converge, with angles—between adjacent extension lines being equal to one another, whereby widths between adjacent guide grooves increase from one end to the other end of the guide grooves.

The pharmaceutical sorting device according to claim 1 or 2, as defined in claim 3, further includes second adjusting unit capable of adjusting a height of the openings and a depth of the receptacles by moving an upper boundary member of the openings up and down and by moving a rear wall facing the openings back and forth.

The pharmaceutical sorting device according to claim 3, as defined in claim 4, further includes an adjusting pocket, in which an adjuster sample is placed, the adjuster sample being for adjusting the width and the height of the openings, and the depth of the receptacles beforehand in accordance with the size of the pharmaceuticals.

In the pharmaceutical sorting device according to claim 4, as defined in claim 5, the second adjusting unit includes a first extending and contracting part connected to the upper boundary member of the receptacles and a second extending and contracting part connected to the rear wall of the receptacles. Moving the first extending and contracting part and the second extending and contracting part simultaneously changes the height of the openings and the depth of the receptacles simultaneously. When one of the upper boundary member and the rear wall contacts the adjuster sample placed in the adjusting pocket, the first extending and contracting part or the second extending and contracting part that is connected to the contacting one of the upper boundary member and the rear wall extends or contracts such as to maintain the contacting one of the upper boundary member and the rear wall in position, while the other one of the first extending and contracting part and the second extending and contracting part moves until the other one of the upper boundary member and the rear wall contacts the adjuster sample.

In the pharmaceutical sorting device according to claim 4 or 5, as defined in claim 6, the adjusting pocket is one of the plurality of receptacles selected at will.

The pharmaceutical sorting device according to any one of claims 1 to 6, as defined in claim 7, further includes discharge unit for discharging the respective pharmaceuticals accommodated in the respective receptacles from the receptacles.

Effects of the Invention

According to the invention as defined in claim 1, the width of the openings can be adjusted by the first adjusting unit to match the size of the pharmaceutical, and when a predetermined amount of pharmaceuticals are conveyed into the receptacles through the openings by the conveyor unit, the receptacles are occupied by the pharmaceuticals. That is, the pharmaceuticals having the same width as the openings will plug the openings. Other pharmaceuticals move forward in the longitudinal direction over the receptacles (over the pharmaceuticals therein) that have already been occupied by the predetermined amount of pharmaceuticals and are accommodated in other receptacles arranged side by side. In other words, a plurality of pharmaceuticals need only be placed at a given location on the conveyor unit, whereby a predetermined amount of pharmaceuticals are dispensed into respective receptacles one by one, by means of the conveyor unit. The first adjusting unit for adjusting the width of the openings has a simple structure made up of a rail, partitions, and a width adjusting drum, and the opening width can be easily matched with the size (width) of the pharmaceutical by rotating the width adjusting drum. Thus, the pharmaceutical sorting device of the present invention can dispense a predetermined amount of pharmaceuticals into respective receptacles easily and quickly with a simple structure.

According to the invention as defined in claim 2, in addition to the effects of the invention according to claim 1, the pharmaceutical sorting device can be configured to be capable of changing the distance between guide grooves, while they are maintained at equal intervals from one another, at a constant rate in accordance with the rotating amount of the width adjusting drum.

According to the invention as defined in claim 3, in addition to the effects of the invention according to claim 1 or 2, as the device further includes the second adjusting unit, the height of the openings and the depth of the receptacles can be freely adjusted to handle pharmaceuticals of various sizes.

According to the invention as defined in claim 4, in addition to the effects of the invention according to claim 3, the height of the openings and the depth of the receptacles can be adjusted beforehand without damaging the pharmaceutical.

According to the invention as defined in claim 5, in addition to the effects of the invention according to claim 4, by operating the second adjusting unit to move the first extending and contracting member and the second extending and contracting member until the upper boundary member of the openings and the rear wall of the receptacles contact an adjuster sample placed in an adjusting pocket so as to change the height of the openings and the depth of the receptacles, the receiving space can be readily adjusted to have substantially the same size as that of the pharmaceutical.

According to the invention as defined in claim 6, in addition to the effects of the invention according to claim 4 or 5, by selecting a given one of the receptacles as the adjusting pocket, the size of the receiving space is readily adjustable without making the structure of the pharmaceutical sorting device complex.

According to the invention as defined in claim 7, in addition to the effects of the invention according to any one of claims 1 to 6, the pharmaceuticals accommodated in the respective receptacles can be discharged and put into a packaging box or the like, whereby pharmaceuticals of various kinds can readily be packaged.

MODES FOR CARRYING OUT THE INVENTION

Figure 1:
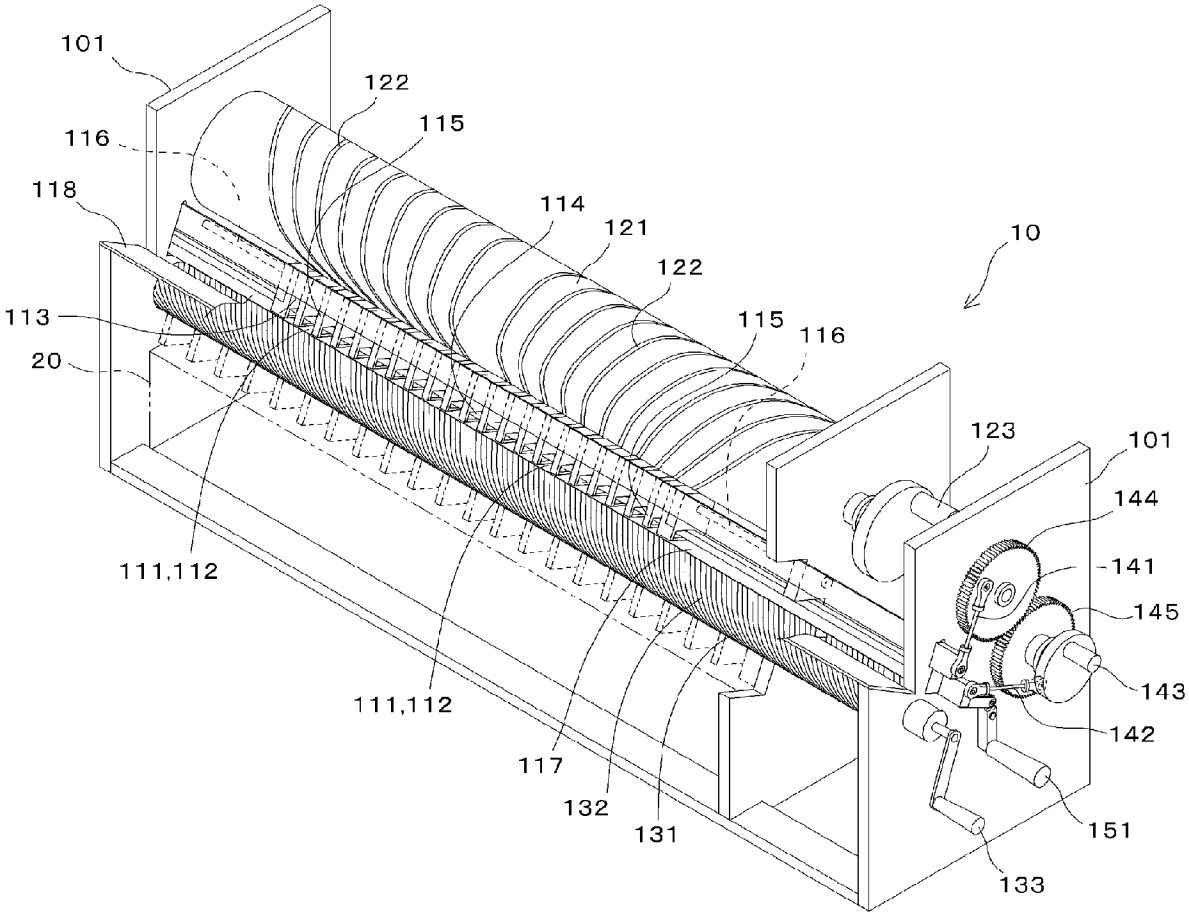
FIG. 1 is an overall perspective view of a pharmaceutical sorting device according to one embodiment of the present invention.

Hereinafter, one embodiment of the present invention will be described with reference to the drawings. The respective drawings to be referred to in the following description present conceptual or schematic views drawn for explanation of preferred configurations, and the dimensions and proportions may not necessarily match the actual dimensions and proportions. In other words, the present invention is not limited to the dimensions and proportions illustrated in the drawings. While the pharmaceuticals are illustrated as round tablets in the drawings for the sake of explanation of the embodiment, they may be square/rectangular tablets, capsules and the like, and their size and shape are not limited to particular ones.

Figure 2:
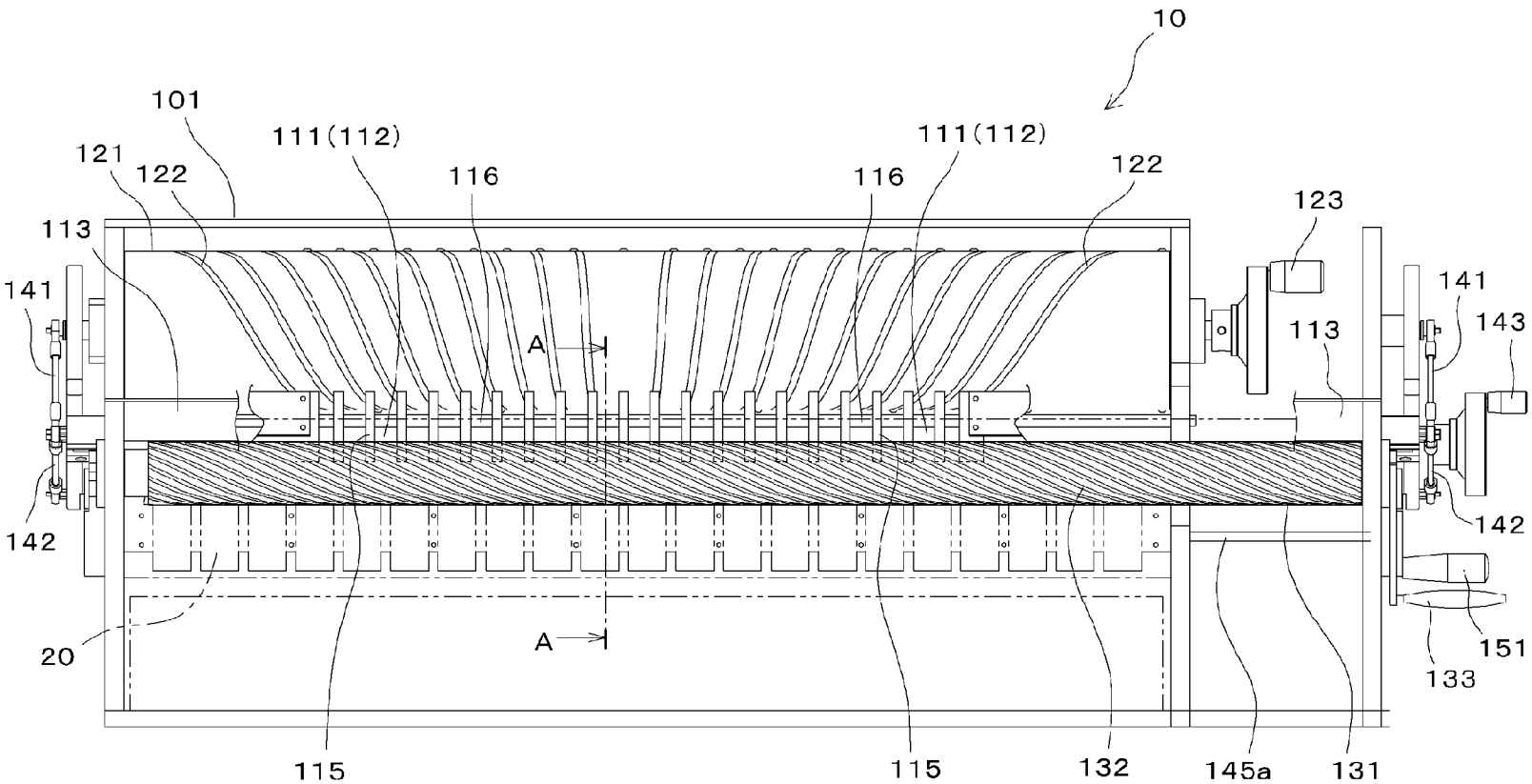
FIG. 2 is a front view of the pharmaceutical sorting device of FIG. 1.

FIG. 1 and FIG. 2 illustrate a pharmaceutical sorting device 10 according to one embodiment of the present invention. The pharmaceutical sorting device 10 includes a support frame 101, a plurality of receptacles 111 for accommodating pharmaceuticals, a conveyor roller 131 for advancing pharmaceuticals from one side to the other to transfer them into the respective receptacles 111, a guide plate 118 arranged along the conveyor roller 131 for keeping the pharmaceuticals on the conveyor roller 131, a width adjusting drum 121 (part of first adjusting unit) provided with a plurality of guide grooves 122 for adjusting the width of the openings 112 of the receptacles 111, second adjusting unit (first extending and contracting shaft 141, second extending and contracting shaft 142, second adjusting handle 143, first gear 144, and second gear 145) for adjusting a height H of the openings 112 and a depth D of the receptacles 111, and discharge unit (discharge shutter 117 and discharge lever 151) for discharging the pharmaceuticals accommodated in the receptacles 111.

The support frame 101 rotatably supports the conveyor roller 131 (with its longitudinal axis being the axis center), and rotatably supports the width adjusting drum 121 (with its longitudinal axis being the axis center) above the conveyor roller 131. The plurality of receptacles 111 with their front side open are arranged side by side along the longitudinal direction of the conveyor roller 131. This conveyor roller 131 is threaded (has grooves 132) so that when it rotates, the grooves 132 and the pharmaceuticals on the conveyor roller 131 are fed forward. A first adjusting handle 123 is provided at one end of the width adjusting drum 121 for rotating the width adjusting drum 121. As will be described later, the partitions 115 defining the openings 112 can be slid in the widthwise direction by rotating the width adjusting drum 121. Below the receptacles 111 is located a packaging box 20 partitioned corresponding to the positions of the receptacles 111. Although not shown, the size of the packaging box 20 is changed in accordance with the size of the pharmaceutical.

Figure 3:
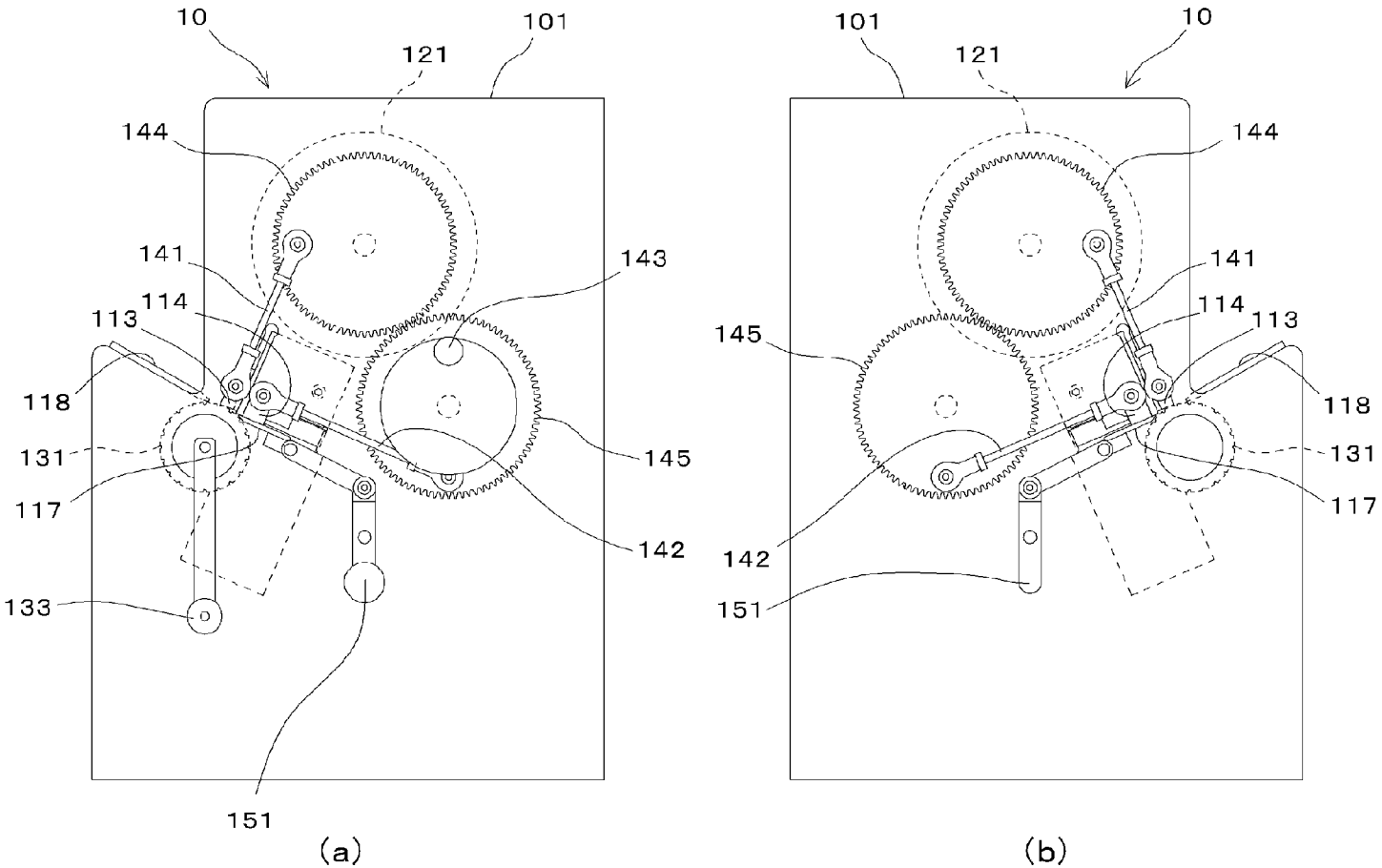
FIG. 3(*a*) is a right side view and FIG. 3(*b*) is a left side view of the pharmaceutical sorting device of FIG. 1.

FIG. 3(*a*) and FIG. 3(*b*) show a right side view and a left side view of the pharmaceutical sorting device 10. As shown in FIG. 3(*a*), on one end face of the pharmaceutical sorting device 10 are provided, as the second adjusting unit for adjusting the height H of the openings 112 and the depth D of the receptacles 111, a first gear 144, a first extending and contracting shaft (extending and contracting member) 141 that can extend and contract and is connected to the first gear 144, a second gear 145 disposed to be able to mesh with the first gear 144, a second extending and contracting shaft 142 (extending and contracting member) that can extend and contract and is connected to the second gear 145, and a second adjusting handle 143 for rotating the first gear 144 and the second gear 145. Also provided is a conveyor handle 133 for rotating the conveyor roller 131. As discharge unit, further, a discharge lever 151 is provided for opening and closing the open/close shutter.

As shown in FIG. 3(*b*), on the other end face of the pharmaceutical sorting device 10 are provided, as the second adjusting unit, a first gear 144, a first extending and contracting shaft 141 (extending and contracting member) connected to the first gear 144, a second gear 145 disposed to be able to mesh with the first gear 144, and a second extending and contracting shaft 142 (extending and contracting member) connected to the second gear 145, to match with those on the one end face described above. The second adjusting handle 143 is connected to the second gear 145, and the second gear 145 at one end of the pharmaceutical sorting device 10 is connected to the second gear 145 at the other end by one shaft 145*a*. That is, the first gears 144 and the second gears 145 at both ends of the pharmaceutical sorting device 10 can be rotated simultaneously by operating the second adjusting handle 143.

Figure 4:
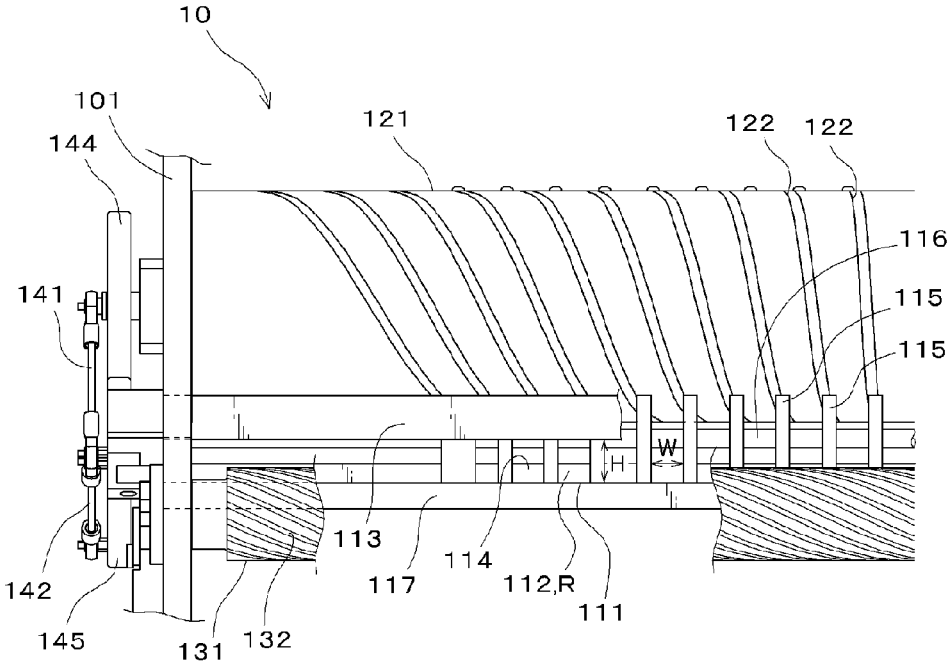
FIG. 4 is an enlarged partial front view of the pharmaceutical sorting device of FIG. 1.
Figure 5:
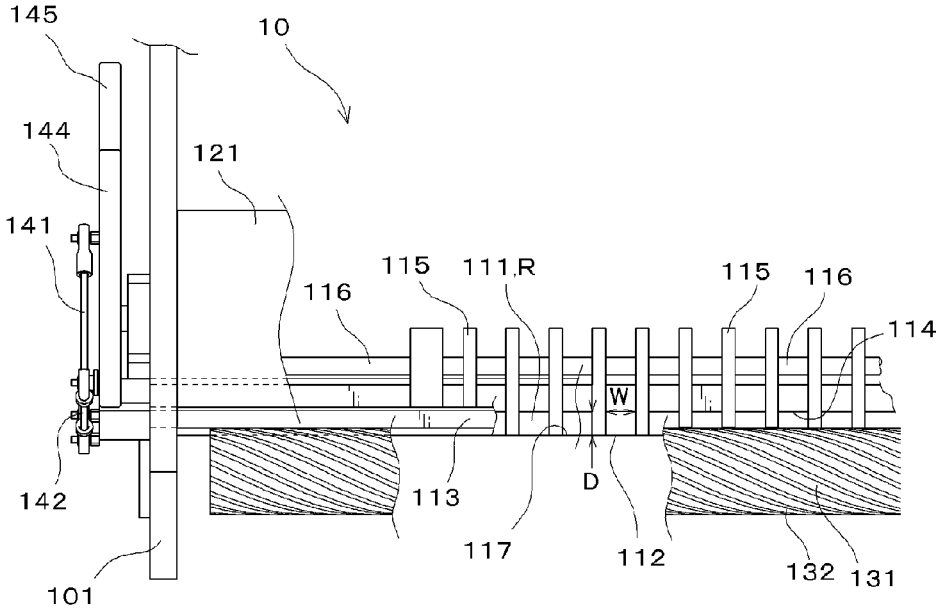
FIG. 5 is an enlarged partial plan view of the pharmaceutical sorting device of FIG. 1.
Figure 6:
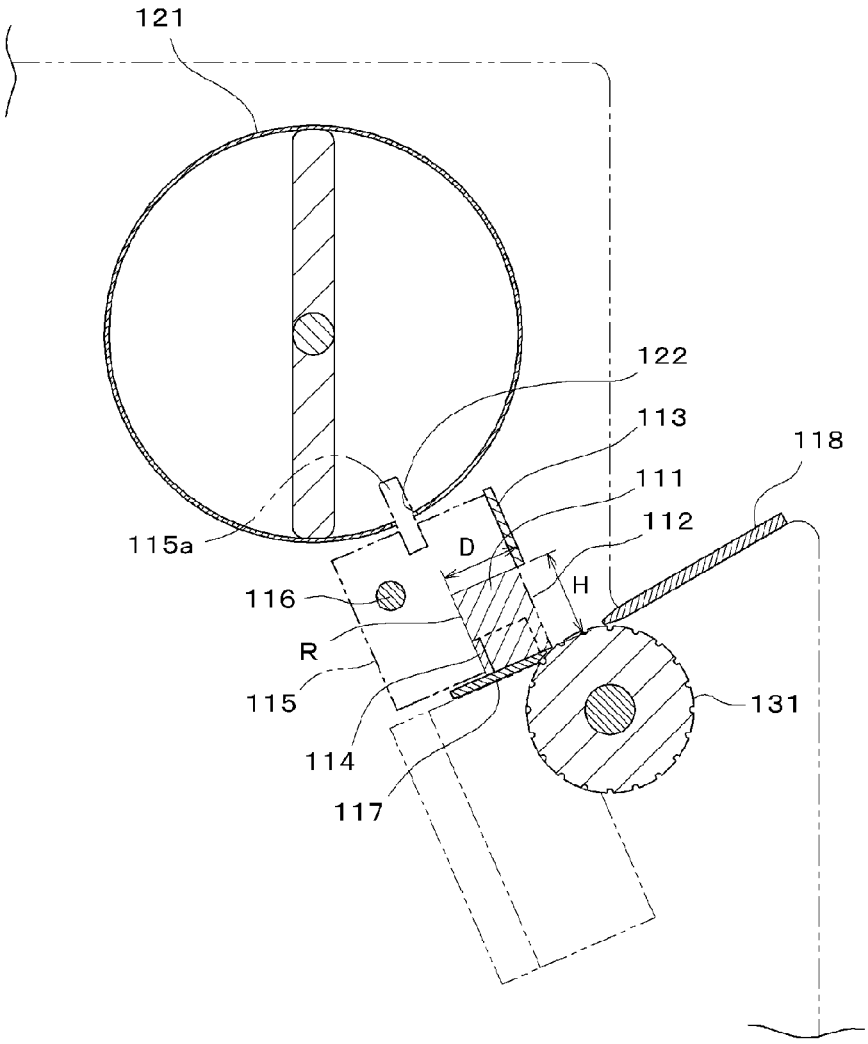
FIG. 6 is a cross-sectional view taken along a line A-A of the pharmaceutical sorting device of FIG. 2.

Next, the respective elements will be described in more detail. FIG. 4 and FIG. 5 are an enlarged partial front view and plan view of the pharmaceutical sorting device 10 of this embodiment. FIG. 6 is a cross-sectional view taken along a line A-A of the pharmaceutical sorting device of this embodiment.

As shown in FIG. 4 and FIG. 5, the receptacles 111 arranged side by side along the longitudinal direction each have an opening 112 that faces the front, this opening 112 being defined by partitions 115, an upper boundary member 113, and a bottom plate 117 (that doubles as the discharge shutter). Adjacent receptacles 111 are divided in the longitudinal direction by partitions 115. The partitions 115 are supported such as to be slidable in the longitudinal direction by means of a rail 116 extending above the receptacles 111 in the longitudinal direction, and held such that their top ends are movable in guide grooves 122 of the width adjusting drum 121. The upper boundary member 113 extends from one end to the other end of the pharmaceutical sorting device 10 such as to cover the upper side of all the receptacles 111, and is supported on the support frame 101 (see FIG. 1 and FIG. 2) such as to be movable in the up and down direction (direction of height H of the openings 112) by means of the second adjusting handle 143, as will be described later. The discharge shutter 117 extends from one end to the other end of the pharmaceutical sorting device 10, and is supported on the support frame 101 (see FIG. 1 and FIG. 2) such as to be movable back and forth by the discharge lever 151, as will be described later.

As shown in FIG. 6, the openings 112 are located close to the outer circumferential surface on the back side of the conveyor roller 131, so that, as the conveyor roller 131 rotates to advance the pharmaceuticals to the openings 112, the pharmaceuticals can be transferred from the conveyor roller 131 into the receptacles 111 through the openings 112. Each partition 115 has a protrusion 115*a* at the top that is arranged movably inside the guide grooves 122 of the width adjusting drum 121. As will be described later, when the width adjusting drum 121 rotates, the partitions 115 move relative to each other in the guide grooves 122. Further, a rear wall 114 located facing the openings 112 is supported on the support frame 101 (see FIG. 1) such as to be movable in the front to back direction (depth direction of the receptacles 111).

In other words, the space R inside each receptacle 111 for accommodating dispensed pharmaceutical is defined by the width W between partitions 115, height H between the bottom plate 117 (discharge shutter) and the upper boundary member 113, and depth D between the opening 112 and the rear wall 114.

Figure 7:
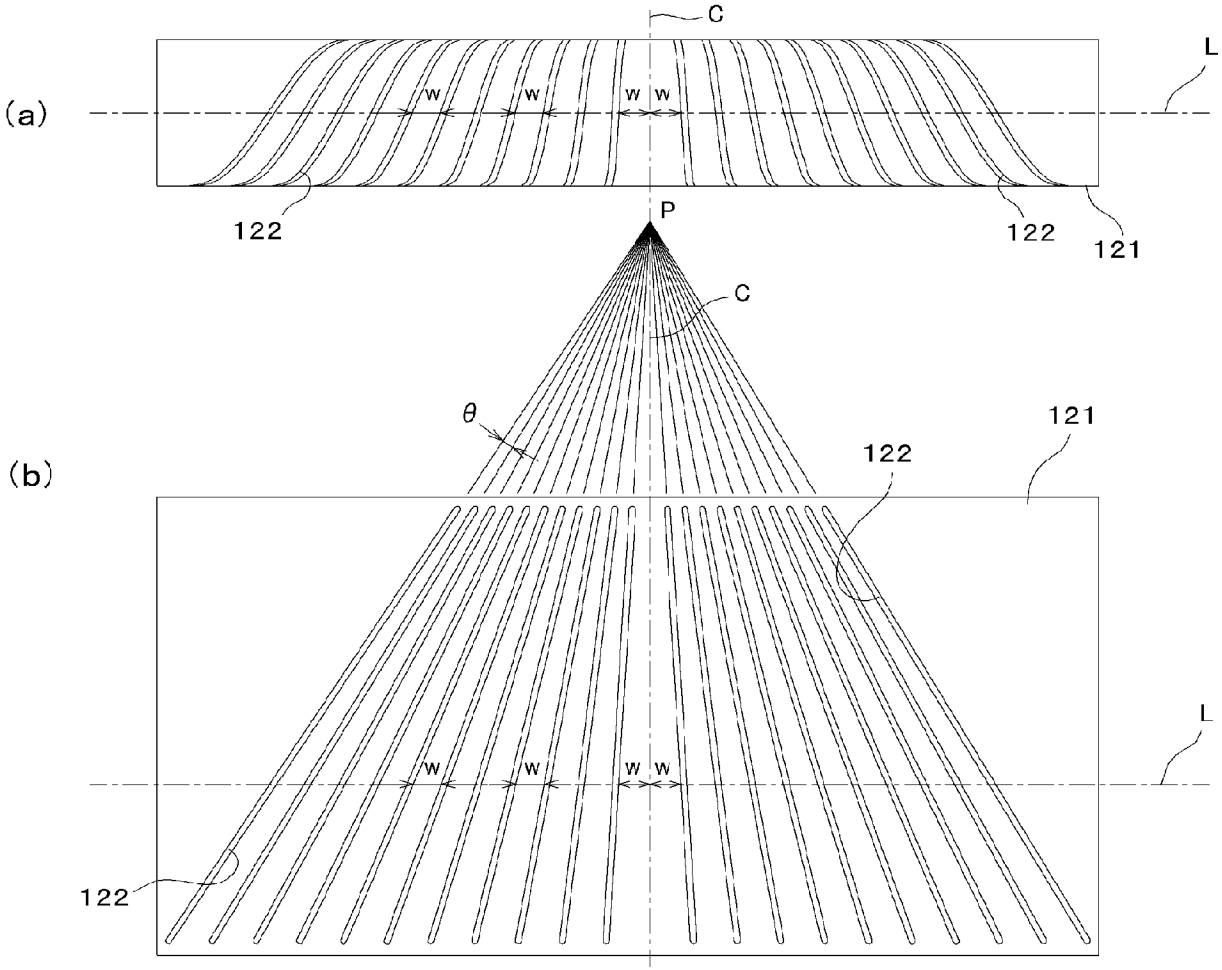
FIG. 7(*a*) is a front view and FIG. 7(*b*) is a development view of a width adjusting drum of the pharmaceutical sorting device of FIG. 1.

FIG. 7(*a*) is a front view of the cylindrical width adjusting drum 121. As shown in FIG. 7(*a*), a plurality of guide grooves 122 (twenty-one grooves in this embodiment) is provided in the form of slots along the outer circumference of the width adjusting drum 121. The guide grooves 122 each extend such as to move away from a center axis C in the longitudinal direction of the width adjusting drum 121 (i.e., the guide grooves 122 extend side by side in a non-parallel manner). The distance between the center axis C and an adjacent guide groove 122 is equal to a respective distances w between respective adjacent guide grooves 122 in the longitudinal axis L (or an axis parallel to the axis L). To illustrate the structure of the width adjusting drum 121, FIG. 7(*b*) shows a development view of the width adjusting drum 121. As shown in FIG. 7(*b*), imaginary extension lines of linear guide grooves 122 converge on a point P on the center axis C, thereby forming a plurality of triangles having the converging point P as one common vertex. Since the angle—between the center axis C and an adjacent extension line is made equal to the angle—between every adjacent extension lines, the distances w between adjacent guide grooves 122 in the longitudinal axis L (or distance w between the center axis C and an adjacent guide groove 122) can be made equal. As the distance w increases from one end (upper end) toward the other end (lower end) of the guide grooves 122, the width W of the openings 112 can be adjusted, as will be described later. Not to mention, the distances between adjacent guide grooves 122 along an axis parallel to the longitudinal axis L are likewise equal.

According to one embodiment, the support frame 101, the width adjusting drum 121, the upper boundary member 113, the discharge shutter 117, the rail 116, and various shafts of the pharmaceutical sorting device 10 are made of metal, while the partitions 115, the guide plate 118, and the conveyor roller 131 are made of hard resin. Note, however, the present invention is not limited to these materials.

Next, a series of operation for adjusting the opening width W of the pharmaceutical sorting device 10 of this embodiment will be described with reference to FIG. 8(*a*) to FIG. 8(*c*).

The partitions 115 are each positioned in the guide grooves 122 as shown in FIG. 4 to FIG. 6, and held such as to be slidable along the rail 116 that extends in the longitudinal direction. Turning the width adjusting drum 121 by operating the first adjusting handle 123 changes the positions of respective guide grooves 122 such as to move away from the center axis C as seen from the front of the pharmaceutical sorting device 10. As the distance w between guide grooves 122 at each opening 112 (at each partition 115) changes, the partitions 115 slide in the longitudinal direction as they move inside the guide grooves 122 relative to each other. In other words, by rotating the width adjusting drum 121 through a certain angle, the partitions 115 can be slid a certain distance in the longitudinal direction, whereby the distances between partitions 115, i.e., the widths W of the receptacles 111 (or openings 112), can be adjusted, while they are maintained equal to one another.

Figure 8:
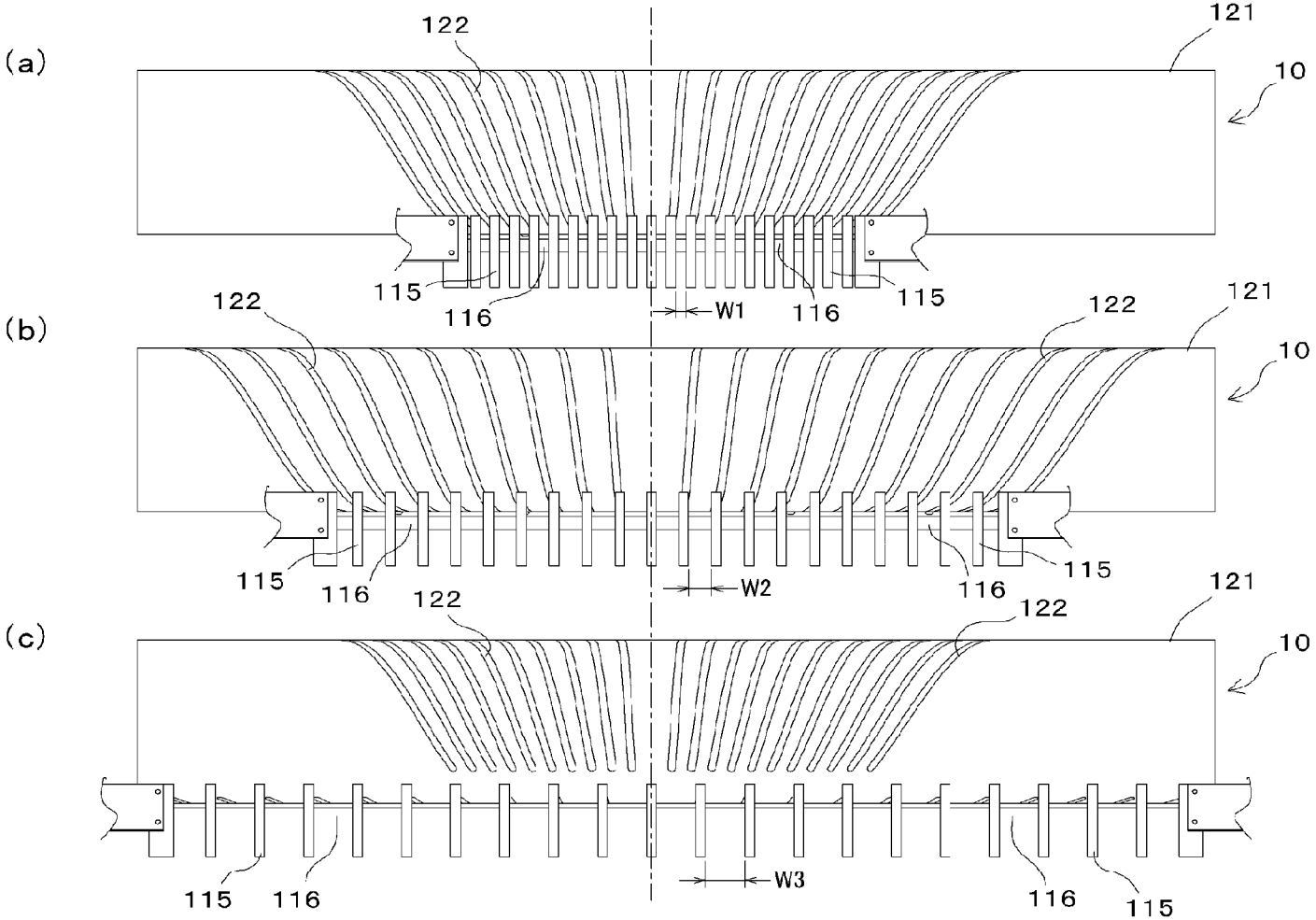
FIG. 8 is a schematic diagram showing a series of operation of the mechanism of adjusting the width of receptacles in the pharmaceutical sorting device of FIG. 1.

FIG. 8(*a*) shows a condition in which the partitions 115 are located at one end of the guide grooves 122. In this state, the width W of the openings 112, which is the distance between partitions 115, is smallest. When the width adjusting drum 121 is rotated toward the reader (in the direction of the arrow) in this state, the distance w between guide grooves 122 at each opening 112 (at each partition 115) increases, and so does the width W of the openings 112 as shown in FIG. 8(*b*). Rotating the width adjusting drum 121 further in the direction of the arrow moves the partitions 115 to the other end of the guide grooves 122 as shown in FIG. 8(*c*), whereby the distance between partitions 115 (i.e., width W of the openings 112) becomes maximum. Although not shown, an adjuster sample having the same size as pharmaceuticals to be dispensed may be put in an adjusting pocket which may be a given receptacle 111, and the width adjusting drum 121 may be rotated until the partitions 115 contact the adjuster sample, so as to adjust the width W of the openings 112 to match the width of a predetermined pharmaceutical.

Next, a series of operation for adjusting the height H of the openings 112 and the depth D of the receptacles 111 of the pharmaceutical sorting device 10 of this embodiment will be described with reference to FIG. 9(*a*) to FIG. 9(*c*).

As has been mentioned in the foregoing, the receiving space R, as seen in a cross section of a receptacle 111, is defined by the opening 112, the upper boundary member 113, the rear wall 114, and the bottom plate 117. The upper boundary member 113 and the rear wall 114 are movable in the up and down direction and in the front and back direction, so that the height H and depth D of the receiving space R are adjustable. The upper boundary member 113 is connected to the first extending and contracting shaft 141 pivotally supported on the first gear 144 and moves up and down in mechanical connection with the first extending and contracting shaft 141 as the first gear 144 rotates. The rear wall 114, on the other hand, is connected to the second extending and contracting shaft 142 pivotally supported on the second gear 145 and moves back and forth in mechanical connection with the second extending and contracting shaft 142 as the second gear 145 rotates. These first and second extending and contracting shafts 141 and 142 can extend and contract, and are biased in the extending direction. Operating the second adjusting handle 143 moves the first gear 144 and second gear 145 simultaneously as they mesh each other.

Figure 9:
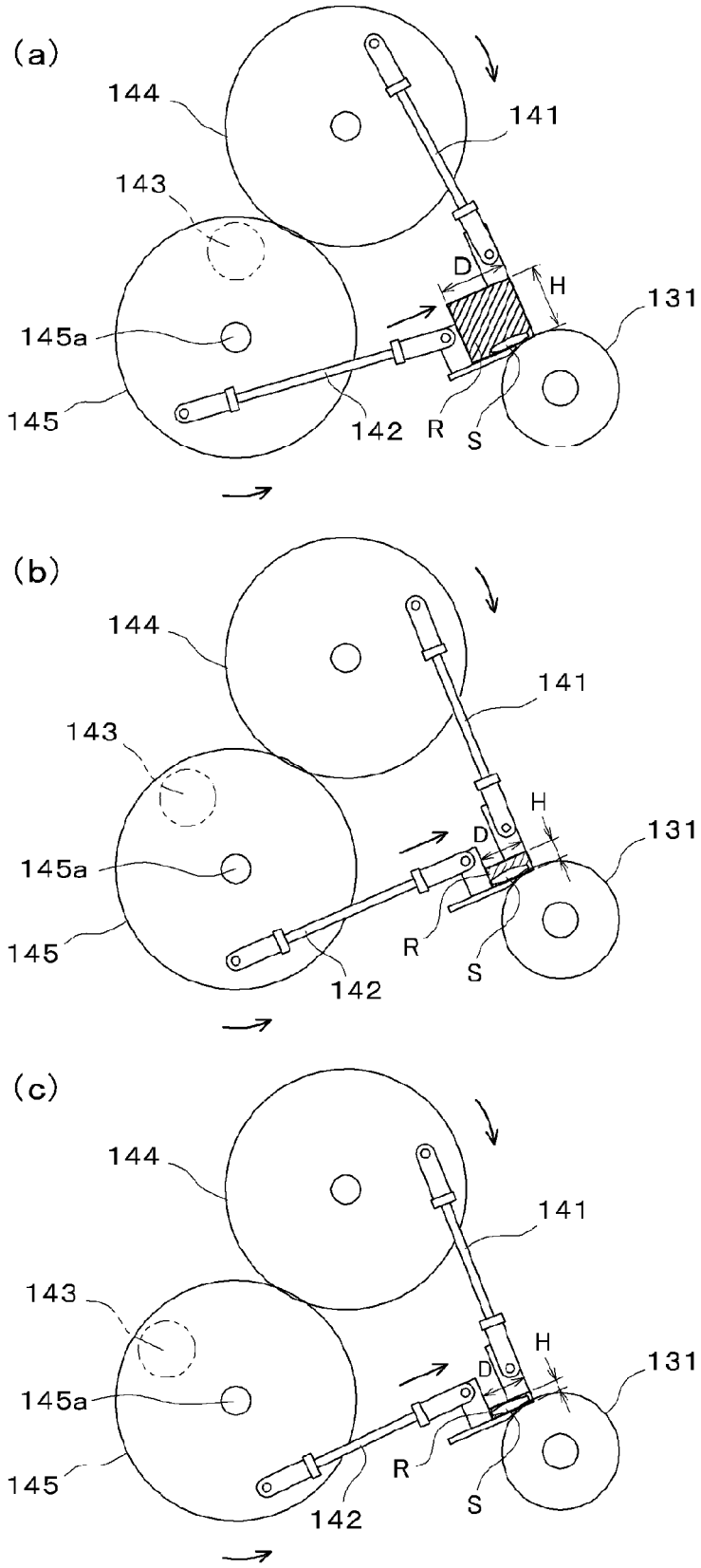
FIG. 9 is a schematic diagram showing a series of operation of adjusting the height of openings and the depth of receptacles in the pharmaceutical sorting device of FIG. 1.

To adjust the height H of the openings 112 and the depth D of the receptacles 111 of the pharmaceutical sorting device 10, an adjuster sample S is placed on a receptacle 111 assigned as an adjusting pocket, as shown in FIG. 9(*a*). In the initial state shown in FIG. 9(*a*), the height H and depth D of the receiving space R are largest. When the second adjusting handle 143 connected to the second gear 145 is operated in this initial state, the first gear 144 and the second gear 145 rotate simultaneously in the directions of arrows to push out the first extending and contracting shaft 141 (upper boundary member 113) and the second extending and contracting shaft 142 (rear wall 114) downward and forward, respectively. When the upper boundary member 113 and the rear wall 114 have moved downward and forward a certain distance, one of the upper boundary member 113 and rear wall 114 (here, the rear wall 114) contacts the adjuster sample S as shown in FIG. 9(*b*). There is still some space above the adjuster sample S in the receiving space R at this time. Operating the second adjusting handle 143 further in this state rotates both of the first gear 144 and the second gear 145 further in the directions of arrows, whereby, while the rear wall 114 remains in contact with the adjuster sample S and the second extending and contracting shaft 142 contracts against the biasing force, the upper boundary member 113 moves downward until it contacts the adjuster sample S. Thus the positions of the upper boundary member 113 and the rear wall 114 are adjusted so that the receiving space R as seen in a cross section of the receptacle 111 has substantially the same dimensions as the cross-sectional dimensions of the adjuster sample S, as shown in FIG. 9(*c*).

While a round tablet having a smaller thickness than its diameter is adopted as the adjuster sample in this embodiment, the sample may be a capsule, or may have any shapes. For example, if the adjuster sample has a shape with a larger thickness than its diameter, the upper boundary member 113 will contact the adjuster sample first and the first extending and contracting shaft 141 will contract against the biasing force as the second adjusting handle 143 is operated, while the rear wall 114 will move forward until it contacts the adjuster sample, so that the receiving space R is adjusted. An actual tablet or capsule may be used as the adjuster sample, but it is preferable to use a hard piece, of metal, for example, having a predetermined size, as the adjuster sample.

As has been described with reference to FIG. 8 and FIG. 9, the receiving space R is adjusted to match the size of the pharmaceuticals to be dispensed by operating the first adjusting handle 123 (width adjusting drum 121) and the second adjusting handle 143 (second adjusting unit).

The receiving space R need not necessarily be adjusted to a size corresponding to one pharmaceutical, and may be adjusted so that one receptacle 111 will accommodate a plurality of pharmaceuticals. In other words, the receiving space R may be adjusted to have a size so that one receptacle 111 can accommodate two or more pharmaceuticals, by multiplying the size (in particular, depth D) of the adjuster sample by an integer.

Figure 10:
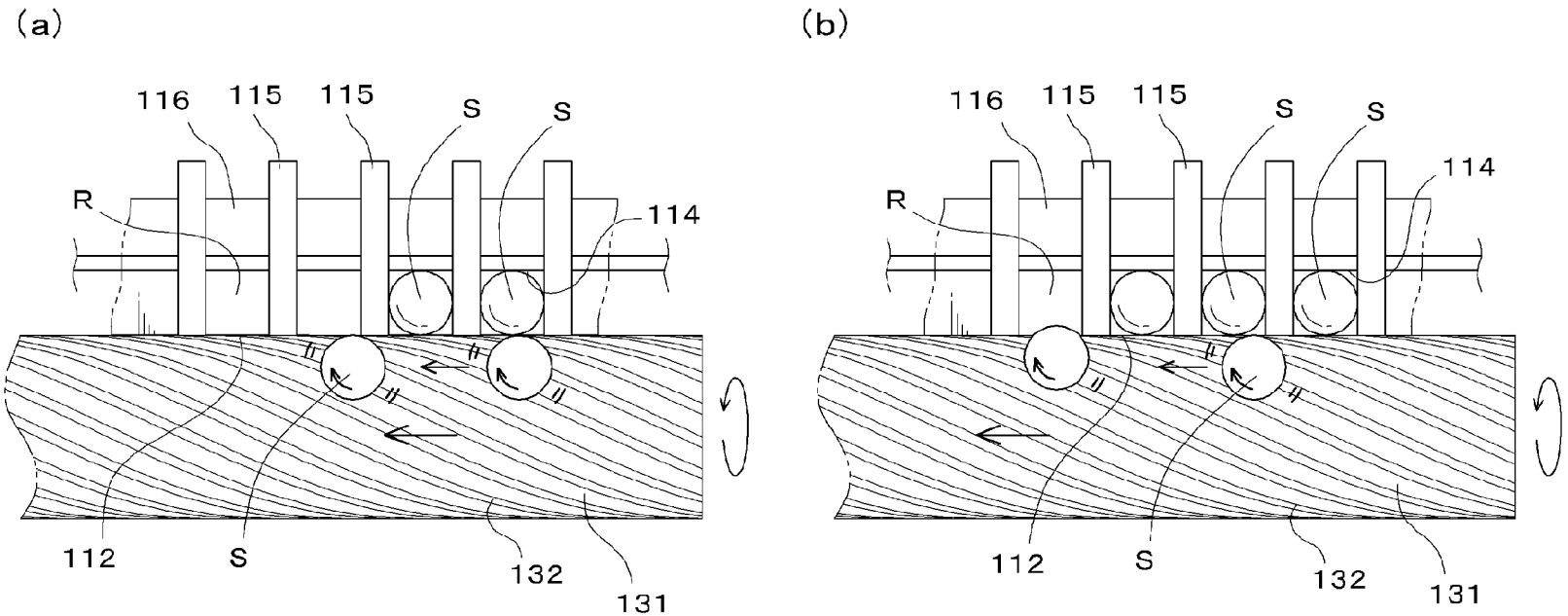
FIG. 10 is a schematic diagram showing a series of operation of accommodating pharmaceuticals in each of the receptacles of the pharmaceutical sorting device of FIG. 1.

Next, how the pharmaceuticals S are dispensed to respective receptacles 111 after the respective receiving spaces R have been adjusted will be described with reference to FIG. 10(*a*) and FIG. 10(*b*). First, a plurality of pharmaceuticals S is placed at one end of the conveyor roller 131. The pharmaceuticals S at this time are placed on the outer circumference of the conveyor roller 131 on the side of the openings 112, because of the guide plate 118 (see FIG. 1) positioned close to the conveyor roller 131. Next, when the conveyor roller 131 is rotated so that the thread grooves 132 on the conveyor roller 131 are fed to the other end, the pharmaceuticals S are transferred to the other end by the grooves 132 contacting the pharmaceuticals S. The pharmaceutical S that is transferred first drops into the receptacle 111 located closest to one end (first receptacle 111) through the opening 112 from the outer circumference of the conveyor roller 131. As the receiving space R has substantially the same size as the pharmaceutical S, the first receptacle 111 is fully taken up by the pharmaceutical S, its opening 112 being plugged up. The pharmaceutical S transferred next rolls past on the pharmaceutical S dispensed in the first receptacle 111 (on the plugged opening 112) and drops into a second receptacle 111 adjacent thereto. This is repeated as shown in FIG. 10, so that the plurality of pharmaceuticals S are dispensed into respective receptacles 111 (not shown) one by one from the receptacle 111 at one end.

Figure 11:
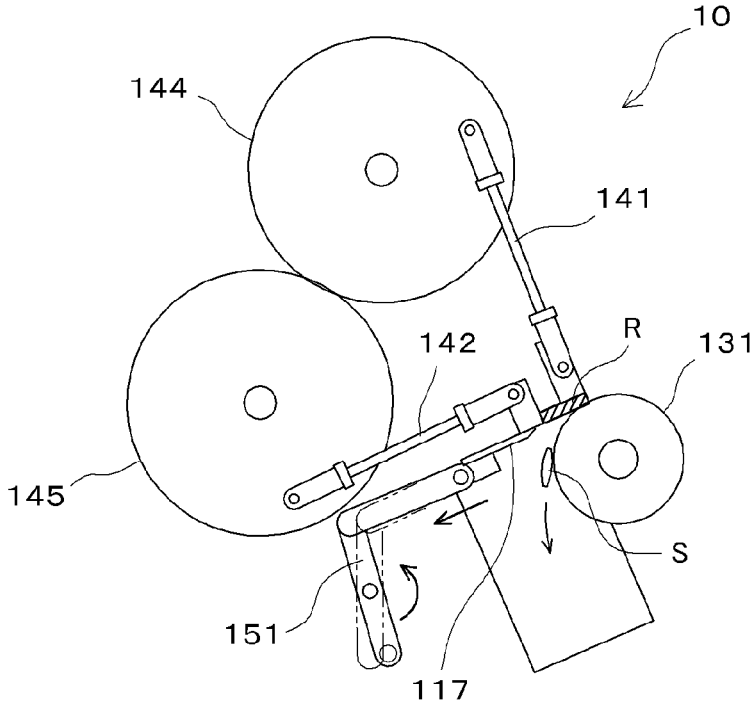
FIG. 11 is a schematic diagram showing how the pharmaceuticals accommodated in the respective receptacles are discharged therefrom by discharge unit in the pharmaceutical sorting device of FIG. 1.

Once the pharmaceuticals S are accommodated in the respective receptacles 111, they are dropped from the receptacles 111 by the discharge unit (discharge lever 151 and discharge shutter 117). As shown in FIG. 11, operating the discharge lever 151 provided on one end face of the pharmaceutical sorting device 10 in the direction of the arrow moves the discharge shutter 117 that doubles as the bottom plate of the respective receptacles 111 backwards, so that the pharmaceuticals S accommodated in the respective receptacles 111 fall. The pharmaceuticals S are then dispensed to a predetermined position in the packaging box 20 (not shown) located beneath the receptacles 111.

The advantageous effects of the pharmaceutical sorting device 10 according to one embodiment of the present invention will be described below.

With the pharmaceutical sorting device 10 according to the embodiment, the width W of the openings 112 can be adjusted by the first adjusting unit to match the size of the pharmaceutical, and when a predetermined amount of pharmaceuticals are transferred into the receptacles 111 through the openings 112 by the conveyor unit (conveyor roller 131), the receptacles 111 are occupied by the pharmaceuticals. That is, the pharmaceuticals having the same width as the openings 112 will plug the openings 112. The pharmaceuticals that are conveyed after that advance forward in the longitudinal direction over the receptacles 111 (over the pharmaceuticals therein) that have already been occupied by the predetermined amount of pharmaceuticals and are accommodated in other receptacles 111 arranged side by side. In other words, a plurality of pharmaceuticals need only be placed at a given location on the conveyor roller 131, whereby a predetermined amount of pharmaceuticals are dispensed into respective receptacles 111 one by one, by means of the conveyor roller 131. The first adjusting unit for adjusting the width W of the openings 112 has a simple structure made up of the rail 116, the partitions 115, and the width adjusting drum 121, and the width W can be easily matched with the size of the pharmaceutical by rotating the width adjusting drum 121. Thus, the pharmaceutical sorting device 10 of this embodiment can dispense a predetermined amount of pharmaceuticals into respective receptacles 111 easily and quickly with a simple structure.

As shown in FIG. 7(*b*), in a development view of the width adjusting drum 121, the angles—between adjacent guide grooves 122 are equal to one another and the guide grooves 122 each extend linearly such as to move away from the center axis C, whereby the pharmaceutical sorting device 10 can be configured to be capable of changing the distances between guide grooves 122 by rotating the width adjusting drum 121, while they are maintained equal to one another (w), at a constant rate in accordance with the rotating amount of the width adjusting drum. As the device further includes the second adjusting unit by which the height H of the openings 112 and the depth D of the receptacles 111 can be adjusted in accordance with the size of the pharmaceutical, the device is capable of changing the receiving space R to match various pharmaceuticals.

Moreover, the pharmaceutical sorting device 10 according to this embodiment is capable of adjusting the height H of the openings 112 and the depth D of the receptacles 111 beforehand without damaging the pharmaceutical, by using an adjuster sample S placed in an adjusting pocket that may be one of the receptacles 111 selected at will. This adjustment is made easily, by operating the second adjusting handle 143 to move the first extending and contracting shaft 141 and the second extending and contracting shaft 142 until the upper boundary member 113 of the openings 112 and the rear wall 114 of the receptacles 111 contact the adjuster sample S placed in the adjusting pocket so that the size of the receiving space R equals to that of the adjuster sample S (of pharmaceuticals to be dispensed).

Furthermore, the pharmaceutical sorting device 10 according to this embodiment includes discharge unit (discharge lever 151 and discharge shutter 117), so that the pharmaceuticals accommodated in the respective receptacles 111 may be dropped into the packaging box 20 located below the receptacles 111 only by operating the discharge lever 151. In other words, the pharmaceuticals can readily be dispensed into the packaging box 20 so that a predetermined amount of pharmaceuticals can be packaged.

Modified Examples

The present invention is not limited to the embodiment described above. For example, a conveyor belt or the like may be used as the conveyor unit instead of the conveyor roller as long as it can transfer pharmaceuticals into the receptacles. The conveyor unit may be driven with a motor or the like. The width adjusting drum of the present invention is not limited to the one of the embodiment. As long as the distances in the longitudinal direction between adjacent guide grooves are equal and the guide grooves are non-parallel, the width adjusting drum may be configured to have guide grooves that are curved in the development view of the drum.

Figure 12:
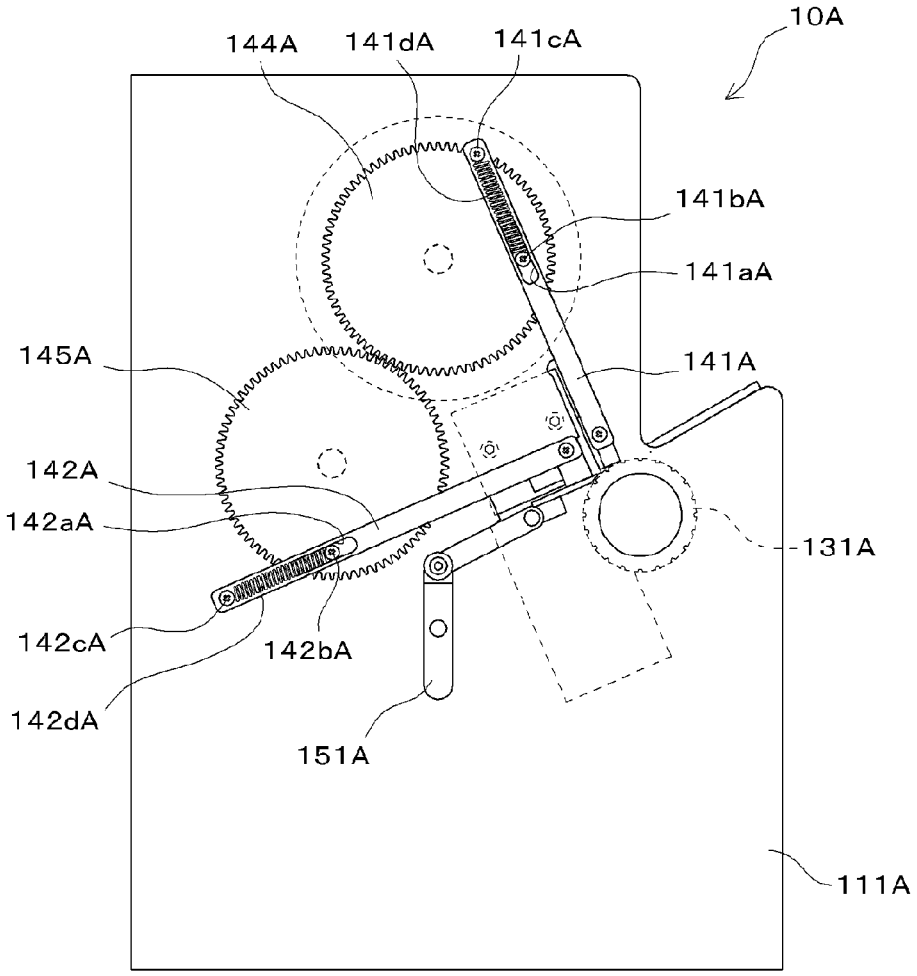
FIG. 12 is a side view of a pharmaceutical sorting device in one modified example of the present invention.

While one embodiment employs extending and contracting shafts 141 and 142 that contract when the upper boundary member 113 or the rear wall 114 contacts the adjuster sample S, the extending and contracting members of the present invention are not limited to these. For example, in a pharmaceutical sorting device 10A of FIG. 12, a first shaft 141A and a second shaft 142A respectively connected to the upper boundary member 113A and the rear wall 114A are connected at connecting rods 141*b*A and 142*b*A to the first gear 144A and the second gear 145A through slots 141*a*A and 142*a*A bored in the shafts. The respective connecting rods 141*b*A and 142*b*A are biased by springs 141*d*A and 142*d*A toward the ends 141*c*A and 142*c*A of the respective shafts 141A and 142A. When the first gear 144A and the second gear 145A rotate to move the upper boundary member 113A and the rear wall 114A downward and forward and one of the upper boundary member 113A and the rear wall 114A contacts the adjuster sample S, the connecting rod (141*b*A or 142*b*A) of the shaft of the contacting one moves inside the slot (141*a*A or 142*a*A) in a direction in which the spring (141*d*A or 142*d*A) extends. That is, the first gear 144A and the second gear 145A do not stop rotation when one of the upper boundary member 113A and the rear wall 114A contacts the adjuster sample S, and keep moving until the other one of the upper boundary member 113A and the rear wall 114A contacts the adjuster sample S. Thus the pharmaceutical sorting device 10A is likewise capable of adjusting the size of the receiving space R to match that of the adjuster sample S.

The present invention is not limited to the embodiment or modified examples described above and may be carried out in various modes within the technical scope of the present invention.

DESCRIPTION OF REFERENCE SIGNS

10 pharmaceutical sorting device
101 support frame
111 receptacle
112 opening
113 upper boundary member
114 rear wall
115 partition
116 rail
117 bottom plate (discharge shutter)
121 width adjusting drum
122 guide groove
123 first adjusting handle
131 conveyor roller
132 groove
133 conveyor handle
141 first extending and contracting shaft (member)
142 second extending and contracting shaft (member)
143 second adjusting handle
144 first gear
145 second gear
151 discharge lever
20 packaging box
R receiving space
S adjuster sample (or pharmaceutical)
C center axis
L longitudinal axis
P converging point

The invention claimed is:

1. A pharmaceutical sorting device for dispensing a plurality of pharmaceuticals, comprising:

a plurality of receptacles for receiving respective pharmaceuticals, arranged side by side along a longitudinal direction and each having an opening for the pharmaceutical to pass through;

conveyor unit for conveying the pharmaceuticals into the respective receptacles through the openings; and first adjusting unit changing a width of the openings in accordance with a size of the pharmaceuticals, the first adjusting unit including a rail extending in the longitudinal direction, a plurality of partitions partitioning two adjacent receptacles and slidable along the rail, and a cylindrical width adjusting drum arranged along the rail and rotatable around an axis extending in the longitudinal direction, the width adjusting drum having a plurality of guide grooves formed side by side at equal intervals in the longitudinal direction such as to extend non-parallel to one another along an outer circumferential direction, so as to guide a sliding movement of the plurality of partitions, wherein the width of the respective openings is changed by a sliding movement in the longitudinal direction along the rail of the plurality of partitions as guided by the respective guide grooves when the width adjusting drum rotates, and wherein the respective openings become plugged by the pharmaceuticals when the pharmaceuticals are conveyed into the respective receptacles.

2. The pharmaceutical sorting device according to claim 1, wherein the respective guide grooves on the width adjusting drum extend, when viewed in a development view, radially from a converging point P where extension lines of the respective guide grooves converge, with angles between adjacent extension lines being equal to one another, whereby widths between adjacent guide grooves increase from one end to the other end of the guide grooves.

3. The pharmaceutical sorting device according to claim 1, further comprising second adjusting unit capable of adjusting a height of the openings and a depth of the receptacles by moving an upper boundary member of the openings up and down and by moving a rear wall facing the openings back and forth.

4. The pharmaceutical sorting device according to claim 3, further comprising an adjusting pocket, in which an adjuster sample is placed, the adjuster sample being for adjusting the width and the height of the openings, and the depth of the receptacles beforehand in accordance with a size of the pharmaceuticals.

5. The pharmaceutical sorting device according to claim 4, wherein the second adjusting unit includes a first extending and contracting part connected to the upper boundary member of the receptacles and a second extending and contracting part connected to the rear wall of the receptacles, wherein moving the first extending and contracting part and the second extending and contracting part simultaneously changes the height of the openings and the depth of the receptacles simultaneously, and wherein when one of the upper boundary member and the rear wall contacts the adjuster sample placed in the adjusting pocket, the first extending and contracting part or the second extending and contracting part that is connected to a contacting one of the upper boundary member and the rear wall extends or contracts such as to maintain the contacting one of the upper boundary member and the rear wall in position, while the other one of the first extending and contracting part and the second extending and contracting part moves until the other one of the upper boundary member and the rear wall contacts the adjuster sample.

6. The pharmaceutical sorting device according to claim 5, wherein the adjusting pocket is one of the plurality of receptacles selected at will.

7. The pharmaceutical sorting device according to claim 4, wherein the adjusting pocket is one of the plurality of receptacles selected at will.

8. The pharmaceutical sorting device according to claim 1, further comprising discharge unit for discharging the respective pharmaceuticals accommodated in the respective receptacles from the receptacles.

* * * * *